US009914013B1

(12) United States Patent
Uhlrich et al.

(10) Patent No.: US 9,914,013 B1
(45) Date of Patent: Mar. 13, 2018

(54) WHEELCHAIR-ACCESSIBLE EXERCISE SYSTEM

(71) Applicant: BAYLOR UNIVERSITY, Waco, TX (US)

(72) Inventors: Scott David Uhlrich, Fort Collins, CO (US); Meka Narrise Sintim, Houston, TX (US); Rachel Leigh Patterson, The Woodlands, TX (US); Travis Blake Watson, Kaufman, TX (US)

( * ) Notice: Subject to any disclaimer, the term of this patent is extended or adjusted under 35 U.S.C. 154(b) by 0 days.

(21) Appl. No.: 14/854,978

(22) Filed: Sep. 15, 2015

Related U.S. Application Data

(60) Provisional application No. 62/050,532, filed on Sep. 15, 2014.

(51) Int. Cl.
*A63B 21/00* (2006.01)
*A63B 22/00* (2006.01)
*A63B 21/015* (2006.01)

(52) U.S. Cl.
CPC ..... *A63B 22/0005* (2015.10); *A63B 21/015* (2013.01); *A63B 22/0002* (2013.01)

(58) Field of Classification Search
CPC .... A63B 2071/0018; A63B 2071/0009; A63B 22/0005; A63B 22/0012; A63B 21/4035; A63B 23/12
See application file for complete search history.

(56) References Cited

U.S. PATENT DOCUMENTS 4,880,227 A * 11/1989 Sowell ..... A63B 21/00072 482/102
5,100,128 A * 3/1992 Mabry ..... A63B 21/0632 482/134
7,857,739 B2 * 12/2010 Caldwell ..... A63B 21/00047 482/130
8,602,948 B2 12/2013 Bohanan

OTHER PUBLICATIONS http://dictionary.cambridge.org/us/dictionary/english/frame, last visited May 10, 2017.*
Unassisted Muscle Strengthening and Conditioning System for Quads, Uppertone, GPK, Inc., El Cajon, CA before Sep. 15, 2014.
The Toolbox Assistive Technology Database, Action Life Gloves, Access to Recreation, Newbury Park, CA Feb. 7, 2013.
Resistance Gym Wall Grid II, Amazon.com before Sep. 15, 2014.
Equalizer 600 Series, EqualizerExercise.com before Sep. 15, 2014.
355 Series Cycle Table Platform, Endorphin Rehabilitation & Fitness Solutions, Pinella Park, FL before Sep. 15, 2014.
360 Pro Gym, Endorphin Rehabilitation & Fitness Solutions, Pinella Park, FL before Sep. 15, 2014.

* cited by examiner

*Primary Examiner* — Loan H Thanh
*Assistant Examiner* — Rae Fischer
(74) *Attorney, Agent, or Firm* — Jackson Walker LLP

(57) ABSTRACT

Various systems, processes, and techniques may be used to achieve a wheelchair-accessible exercise system. In particular implementations, a wheelchair-accessible exercise system may allow a user to perform strength and cardiovascular exercises without having to reposition his/her wheelchair.

(Continued)

For example, a user may perform seven different exercises without moving his/her chair, or possibly even the trunk of their body. Thus, the exercise system may provide a comprehensive workout without requiring repositioning of the wheelchair, which can be quite cumbersome to those that are mobility challenged. Moreover, the exercise system may be adjustable and safe.

30 Claims, 4 Drawing Sheets

WHEELCHAIR-ACCESSIBLE EXERCISE SYSTEM

RELATED APPLICATIONS

This application claims priority to U.S. Patent Application No. 62/050,532, which was filed on Sep. 15, 2014. This prior application is incorporated herein by reference in its entirety.

BACKGROUND OF THE INVENTION

There are between 250,000 and 350,000 people living in the United States with spinal cord injuries, and there are approximately 12,000 new cases each year. Improved emergency care for people with spinal cord injuries and aggressive treatment and rehabilitation can minimize damage to the nervous system and even restore some function to the patient.

Spinal cord injury primarily affects young adults. The average age of injury is 41 years old, and over 80% of spinal cord injuries occur among males. Rehabilitation programs combine physical therapies with skill-building activities and counseling to provide social and emotional support.

The remaining physical functions need to be exercised so the body as a whole can benefit from the physiological adaptations of exercise that will improve overall health. Spinal cord injury patients die most often from heart and lung diseases, as well as infections. These can be prevented, in part, through exercise. There is also a growing body of scientific evidence demonstrating that exercise results in biological adaptations that may benefit the repair and regeneration of neurons in the spinal cord.

A large number of spinal cord injury survivors who could benefit greatly from a suitable program of physical activity are barred from participation because of incorrect perceptions about their functional capacity and undue concern about causing further harm. Commonly expressed concerns are exacerbation of spasticity and contractures, perceived inability to perform basic movements safely, and a substantial risk of falling. The notion that exercise (particularly resistance training) might exacerbate spasticity has now been refuted, and there is good evidence that individually tailored resistance or aerobic exercise programs can be performed safely after stroke or spinal cord injury. If such programs are not initiated, the reduced ability for movement and perceived barriers to exercise commonly lead to a progressive decrease in the individual's overall physical activity, with all the adverse effects of concomitant physical deconditioning.

SUMMARY

Various systems, processes, and techniques for a wheelchair-accessible exercise system are disclosed. In certain implementations, a wheelchair-accessible exercise system may allow a user to perform both strength and cardiovascular exercises without having to reposition his/her wheelchair. For example, a user may perform seven different exercises without moving the wheelchair. (In particular implementations, the user may not even have to move the trunk of his body to perform the exercises.) Thus, the exercise system may provide a comprehensive workout without requiring repositioning of the wheelchair, which can be quite cumbersome to users who are mobility challenged. Moreover, the exercise system may be adjustable and safe. For instance, the exercise system may use hydraulic cylinders, which do not store potential energy, like a vertically displaced weight, and offer varying resistances.

A variety of other features will be apparent to those skilled in the art from the following detailed description and claims, along with the accompanying drawings.

DETAILED DESCRIPTION

Several of the described wheelchair-accessible exercise systems offer an accessible, adjustable, safe, simple, and comprehensive workout for wheelchair-bound individuals by combining resistance exercises and cardiovascular exercises. Users can maneuver their wheelchairs directly to the systems, lock their wheelchairs in place, and perform multiple (e.g., seven) different exercises without moving their wheelchairs or possibly even the trunks of their bodies.

Individuals can become wheelchair bound from a variety of different injuries and diseases, and the sedentary lifestyle that ensues has a number of different health consequences. A consistent fitness program that incorporates both strength and cardiovascular exercises can help these individuals prevent heart disease, diabetes, muscle spasms, and pressure sores. The development of safe, accessible fitness equipment will likely improve the health and extend the lives of many individuals who have suffered a traumatic spinal cord injury, stroke, or lower limb amputation, the elderly, and potentially those with degenerative muscular diseases such as multiple sclerosis.

Figure 1:
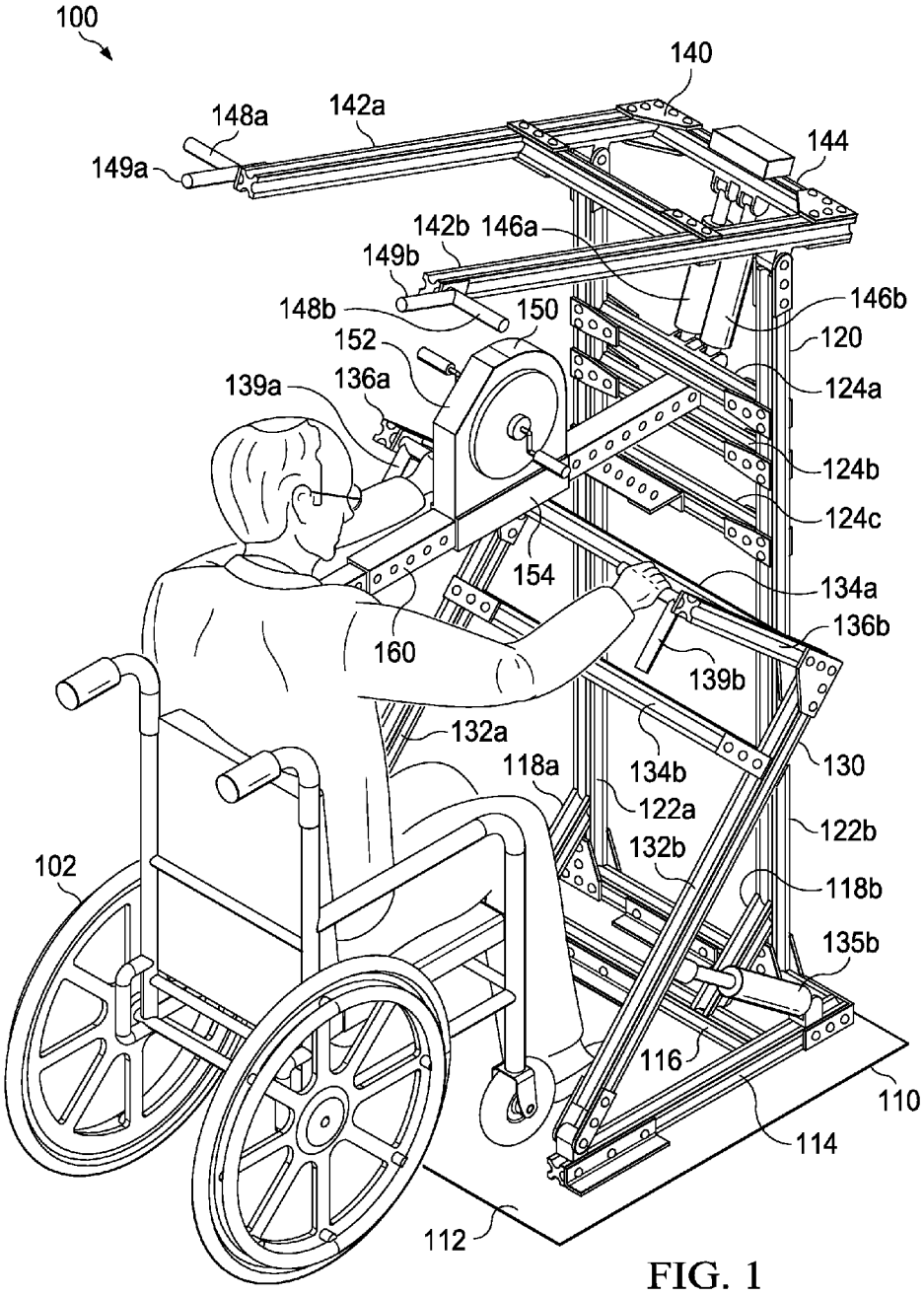
FIG. 1 is an isometric view of an example wheelchair-accessible exercise system.
Figure 2:
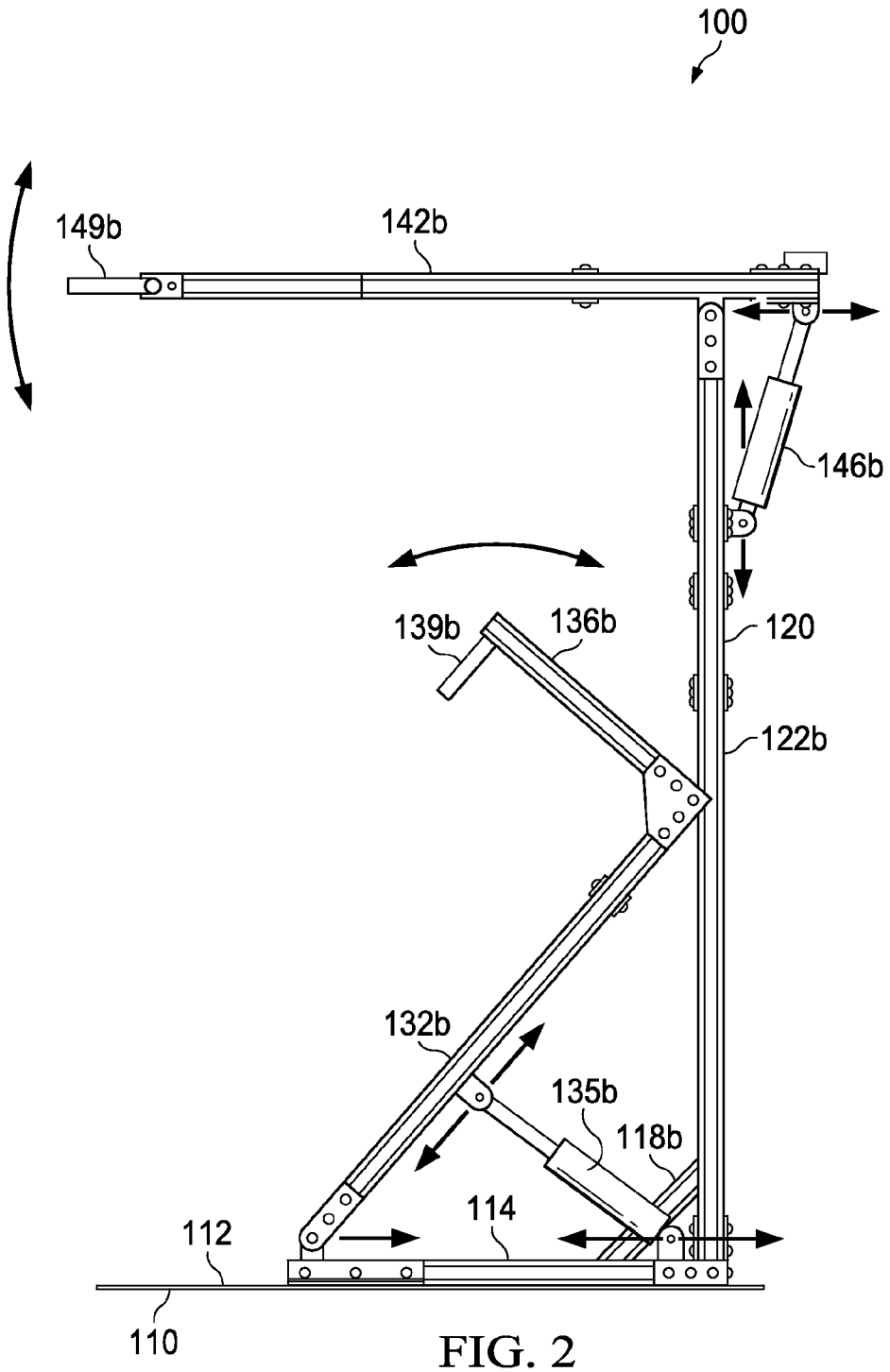
FIG. 2 is a side view of a portion of the example exercise system in FIG. 1.
Figure 3:
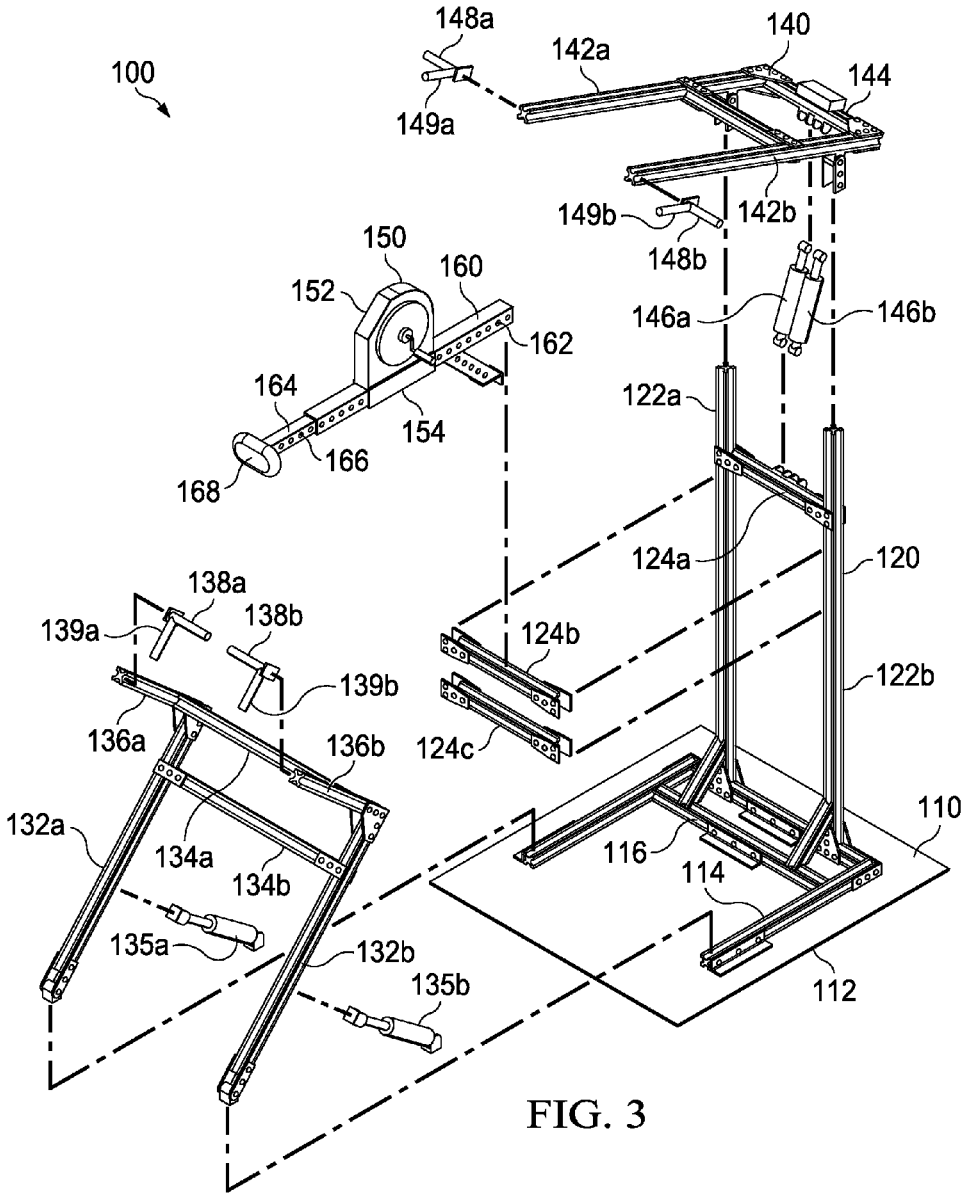
FIG. 3 is an exploded view of the example exercise system in FIG. 1.

FIGS. 1-3 illustrate an example wheelchair-accessible exercise system 100. System 100 offers a wheelchair-bound individual resistance exercises (e.g., a lat pull-down, a shoulder press, a close-grip pull-down, a close-grip military press, a chest press, and a row) and cardiovascular exercises (e.g., a hand cycle).

System 100 includes, among other things, a base assembly 110, a frame 120, a horizontally pivoting assembly 130, a vertically pivoting assembly 140, and a cardio assembly 150.

Base assembly 110 supports system 100 and should be large and strong enough to provide a stable platform while a user performs exercises. In the illustrated embodiment, base 110 includes a base plate 112 and a U-shaped frame 114. The base plate may, for example, be made of 0.125 inch (3 mm) steel. In this implementation, base plate 112 is welded to steel L-brackets that couple it to frame 114, which may, for example, be made of extruded aluminum or steel. Base plate 112 may be coupled to frame 114 in other manners in other implementations. Frame 114 has sufficient width to allow access for at least the front of a wheelchair 102. Typical wheelchairs have a width between 24-30 inches. Thus, frame 114 may be 24 inches wide or wider. In certain implementations, frame 114 may be approximately 35 inches wide.

Base assembly 110 also includes a cross member 116 inside frame 114. Cross member 116 is coupled at its ends to frame 114 and to frame 120 by angled members 118.

Frame 120 is coupled to base assembly 110 and vertically supports vertical pivoting assembly 140 and cardio assembly 150. Frame 120 should have sufficient strength to not only support the other components statically but also while they are being dynamically loaded by the user. As part of this, frame 120 is coupled to U-shaped frame 114, which generally holds frame 120 upright, and cross member 116 (i.e., by angle members 118), which provides for stability to counteract moments in the frame caused by pull-down exercises and the like. Additional support beams may be added to this assembly to prevent excessive deflection in the vertical members.

In the illustrated embodiment, frame 120 includes two vertical members 122 and three cross members 124. Cross members 124 may be movable on vertical members 122 to adjust their height.

Horizontally pivoting assembly 130 is pivotally coupled to frame 114 of base assembly 110 at two locations and includes two pivoting members 132 and cross members 134, which keep pivoting members 132 aligned (e.g., by preventing torsion in the pivoting assembly). In the illustrated embodiment, pivoting members 132 are pivotably coupled to frame 114 near the ends of the U-shape to provide a large range of motion for pivoting assembly 130. Pivoting members 132 may be coupled to base 110 at other locations in other embodiments.

Pivoting members 132 are spaced apart from each other so that at least the front of a wheelchair may fit between them. Cross member **134*b*** may be positioned to be above the user's knees, especially if the cross member moves over the user's thighs during an exercise (e.g., during a rowing stroke). In other implementations, the cross member may be lower than a user's thighs (e.g., if the cross member does not reach the users knees during an exercise).

Coupled between each pivoting member 132 and frame 114 is a hydraulic cylinder 135. Hydraulic cylinders 135 are mounted to the right and left side of the assembly so there is no interference with the user's feet.

Appropriate hydraulic cylinders 135 are, for example, available from FitExpress of Mooreville, Miss. (USA). These cylinders may be unidirectional, so two cylinders may provide bidirectional resistance. (In certain implementations, four unidirectional cylinders may be used—two on each side—to better balance the resistance). In other implementations, hydraulic cylinders 135 may be bidirectional. One, two, or more bidirectional hydraulic cylinders could be used. In other implementations, other types of resistance devices could be used (e.g., pneumatic cylinders).

In certain implementations, one or more cylinders may have a variable resistance that can be adjusted by the user (e.g., by varying the orifice size that the hydraulic fluid passes through). This will allow for adjustment depending on the resistance force of the cylinders desired by the user. The adjusters may be placed at a convenient location (e.g., where the user does not have to adjust his/her position to adjust resistance). For example, the cylinders may be adjusted with paddle adjusters mounted to the hand cycle/support subsystem or frame 120.

In particular implementations, the resistance may also be adjusted by varying the lever arm length associated with the cylinder (e.g., by adjusting the cylinder attachment point). This may change the resistance of the cylinders and the desired force input range of the user.

Horizontally pivoting assembly 130 also includes extending members 136, which project substantially perpendicular to pivoting members 132. Coupled to the ends of extending members 136 are two sets of handles 138, 139. Handle sets 138, 139 allow a user to perform modifications of the same exercise (e.g., a chest press). Which handles to use is primarily a matter of user preference since the same major muscle groups will be activated no matter which handle set is used, although different stabilizer muscles will be activated.

Vertically pivoting assembly 140 is pivotally coupled to frame 120 at two locations and includes two pivoting members 142 and a cross member 144 in the illustrated example. Coupled between cross member 144 and cross member **124*a* of frame 120 are two hydraulic cylinders 146, which are unidirectional—one supplying resistance in one direction, and one supplying resistance in another direction. (In other implementations one or more bidirectional hydraulic cylinders may be used.) Cross member 124*a* is adjustable so that the hydraulic lever arm can be changed for a tailored resistance range for a user's capabilities. Although shown as coupling to the outside of frame 120 and assembly 140, hydraulic cylinders 146 may be coupled between frame 120 and assembly 140 at other points (e.g., to the inside of frame 120 and assembly 140**).

Coupled to the ends of pivoting members 142 are two sets of handles 148, 149. Handle sets 148, 149 allow a user to perform modifications of the same exercise (e.g, a lat pull). Which handle sets 148, 149 used affects the major muscle groups activated, as well as the stabilizer muscles, although user preference will probably play some role in which handle sets a user uses.

As illustrated, frame 120 is approximately 59 inches (1.8 m) tall. Frame 120 may be other heights in other implementations. For example, frame 120 may be between approximately 45-50 inches (1.2 m-1.4 m) tall.

Cardio assembly 150 includes a hand cycle 152. Hand cycle 152 may for example, be a BCG hand cycle available from Academy Sports of Katy, Tex. (USA). Coupled to the bottom of hand cycle is an adapter 154. Adapter 154 slidably couples hand cycle 152 to system 100, so that it may be adjusted for a user.

Cardio assembly 150 is coupled to vertical frame 120 by a horizontal support 160. Horizontal support 160 is sized to support cardio assembly 150 during use, and adapter 154 is sized to slidably fit around horizontal support 160. For example, adapter may be a 2.00 inch (4 mm) channel, and horizontal support 160 may be a 1.75 inch (3.5 mm) pipe. Moreover, horizontal support 160 and adapter 154 are configured to lockingly engage with each other. In the illustrated embodiment, horizontal support 160 includes a number of apertures 162 therein. Adapter 154 may include one or more pins (e.g., manual or spring loaded) for engaging the apertures to secure the adapter and, hence, hand cycle 152 relative to the horizontal support.

Horizontal support 160 is coupled to cross members **124*b*, 124*c* of frame 120. Cross members 124*b*, 124*c*** can move vertically so that the cardio system can be custom fit to the height of the user.

In other implementations, a hand cycle with a center of rotation closer to the user's shoulder level may be used. For instance, a cycle like the InStride Cycle from Stamina Products, Inc. of Springfield, Mo. (USA) could be modified by placing the bearing block on or close to the horizontal support 160.

In this embodiment, horizontal support 160 also includes a chest engagement assembly 164. In particular, chest engagement assembly 164 includes a member 166 that slidably interacts with support 160 and a chest engagement portion 168 (e.g., a pad). For example, member 166 may be a 1.50 in (3 mm) square pipe that telescopes out of horizontal support 160. In the illustrated implementation, member 166 has a number of apertures that align with apertures in horizontal support 160. The member may be engaged with the support by one or more pins. Chest engagement portion 168 is located at one end of member 166 and provides resistance to trunk movement during exercise. In particular, users that have injuries from the mid-thoracic region to the lumbar region are likely to have abdominal control problems. Thus, chest engagement portion 166 may assist in maintaining these users at a proper position (e.g., in preventing fore and aft motion) Chest engagement portion 166 may also assist in preventing lateral motion and/or twisting.

Base 110, frame 120, horizontally pivoting assembly 130, and vertically pivoting assembly 140 assembly may, for example, be made out of 8020 extruded 6105-T5 aluminum alloy. In other implementations, welded steel square tubing may be used. Other appropriate materials are well known to those of skill in the art.

In certain modes of operation, the user maneuvers his wheelchair up to system 100, engages the brakes of the wheelchair, performs necessary adjustments (e.g., positions chest engagement portion 168, positions hand cycle 152, etc.), and conducts a variety of resistance and cardiovascular exercises without changing positions. The weight of the user and the wheelchair will assist in securing system 100 to the ground. With the three exercise assemblies in system 100, a user may perform a total of seven different exercises.

Horizontally pivoting assembly 130 allows a user to perform a chest press and a seated row with two different grip positions, hydraulic cylinders 135 providing resistance in both directions of motion. In particular, the row would be performed by the user pulling the assembly toward him, and the chest press would be performed by the user pushing the assembly away from him. Thus, a user can perform two exercises at the same time. In the illustrated example, assembly 130 pivots through a range of about 60 degrees to 90 degrees. In other implementations, it may pivot through a range of about 30 degrees to 90 degrees. During exercises, handle sets 138,139 may move across the top portion of the arc (i.e., move back and forth about a vertical line that projects upwards from the pivot). With the illustrated geometry, this may be accomplished while avoiding the user's knees.

Through using handle sets 148, 149, vertically pivoting assembly 140 allows a user to perform a lat pulldown, a shoulder press, a close grip pulldown, and a close grip military press. In particular, the pulldown would be performed by the user pulling the assembly toward him, and the shoulder/military press would be performed by the user pushing the assembly away from him.

In the illustrated example, assembly 140 pivots through a range of about 60 degrees to 90 degrees. In other implementations, it may pivot through a range of about 30 degrees to 90 degrees. For instance, if vertical members 122 were shortened substantially, the angular range would change. In certain implementations, handle sets 148,149 may move across the side portion of the arc (i.e., move back and forth about a horizontal line that projects outward from the pivot).

Cardio assembly 150 allows a user to perform high repetition cardiovascular exercise. In particular, the user may crank the hand cycle with their arms (similar to a cranking a bicycle with your feet) to generate a cardiovascular workout.

By using hydraulic cylinders, the resistance of the system is proportional to the force applied to the system. In particular, the resistance provided by the cylinder is proportional to the velocity of the cylinder rod. Thus, the user can readily adjust the amount of resistance applied by system 100 (e.g., in response to the body's growing or waning strength). This allows independence to be achieved.

Additionally, in particular implementations, the resistance provided by the cylinders may also be adjustable, which may be useful to accommodate different users or to provide increased resistance as the user progresses. In embodiments that have variable hydraulic cylinders, system 100 may also accommodate asymmetric function in a user. For example, one side of the user's body may be in better physical condition than the other. By adjusting the hydraulic cylinders differently (e.g., based on cylinder placement and/or resistance), system 100 can provide varied resistance System 100 has a variety of other features. For example, the user may perform both strength and cardiovascular exercises on one machine. While many systems allow wheelchair-bound users to perform strength exercises, they do not include a cardiovascular exercise option despite cardiovascular disease being the leading cause of death in stable patients with spinal cord injuries. The unique combination of low weight, high repetition exercises (hand cycling, low resistance hydraulic exercises) with high weight, low repetition motions (high resistance hydraulic exercises) enables the user to accomplish both strength, endurance, and calorie burning fitness goals with the same machine. Existing solutions focus on resistance or cardiovascular fitness, but none offers a comparable range of exercises.

Moreover, these exercises may be performed without the user having to reposition their wheelchair. Once the user has locked his/her wheelchair in place, both sets of hydraulic resistance assemblies as well as the hand cycle are within arm's reach. Wheelchair-bound users with complete lower limb paralysis and/or upper limb involvement are challenged by the dynamics of existing systems that require awkward repositioning during the course of exercise and may be challenged to bend and reposition components like pins and bands, which require a large range of motion by the user, making machines with this technology impractical for users with limited range of motion and muscle control.

Additionally, by using hydraulic cylinders, bulky weight stacks or elastic bands that store energy and can be a safety risk if they are dropped or released, which is a much higher risk for users with compromised motor control, poor grip, and muscle spasms, may be eliminated. If the user loses strength or control during a hydraulic exercise, they can remove their hands from the system, and the handles will remain stationary instead of dropping or snapping, potentially injuring them. Moreover, no adjustments have to be made to increase or decrease resistance, which is a beneficial for user's who are wheelchair bound.

Since handicapped individuals do not have the same physical capabilities, system 100 allows a variety of adjustments to accommodate the needs of a variety of users. Hydraulic cylinders 135 can be put both on either side or one on each side to accommodate strength imbalances. The capability to mount the hydraulics in multiple configurations may be extremely beneficial for home-health customers as many neuromuscular ailments or injuries leave the customer with asymmetrical strength (e.g., MS, stroke, amputation). Additionally, the hydraulic attachment points can be moved up and down in the framing, allowing the user to adjust the range of resistance provided by the hydraulics (changing mechanical advantage between user input and hydraulic resistance) as well as the stopping points for the members.

The chest engagement assembly is also adjustable. For example, the height of the chest engagement portion can be changed (e.g., by adjusting members 124*b*-124*c*) so that it contacts different users in the correct location on the upper chest (roughly the length of the sternum superior to the xyphoid process). The chest engagement portion can also be adjusted fore and aft (e.g., by adjusting member 164). The chest engagement portion may be left in a contracted position after each use. For the next use, the user (whether the same or different) can maneuver up to a designated location on the baseplate, lock his/her wheelchair, then pull out the chest engagement portion to the appropriate location. This is a safer solution than the user wheeling up to a stationary chest pad. The fore and aft position of the hand cycle can be adjusted for differences in user arm length.

A non-handicapped individual can use the machine easily by pulling up a seat (e.g., a chair or a bench). A heavy bench-style could be manufactured as an accessory for home-health users who want the machine to be usable by others in the home.

Additional adjustment features in other embodiments may include locating the adjustments for hydraulic cylinders remotely therefrom (e.g., on frame 120 or horizontal member 160). Thus, the adjustment may be readily accessible to the user while in the wheelchair, and maybe even adjustable while in the exercise position.

Although FIGS. 1-3 illustrate an example wheelchair-accessible exercise system, other wheelchair-accessible exercise systems may include fewer, additional, and/or a different arrangement of components.

In certain implementations, the hand cycle may not be present. For instance, the system may not come equipped with a hand cycle or the hand cycle may be removed (e.g., by pulling free from horizontal support 160).

Some implementations may not include a base plate. For instance, the base may be sturdy and wide enough to support the system without the plate. Additionally, certain implementations may not include a base. For example, the system may be mounted to a wall.

Additionally, certain implementations may not include horizontally pivoting assembly 130 or vertically pivoting assembly 140. Moreover, assembly may not include two sets of handles.

In certain implementations, the chest pad may be removed, especially if the user does not have abdominal control problems. For instance, the system may not come equipped with a chest pad or the chest pad may be removed.

Particular implementations may include handgrips on one or more handles. These may ease the user's interaction with systems. Handgrips may be made of rubber, plastic, foam, or any other appropriate material.

In certain implementations, an exercise system may include a strap to help secure a user. For example, a strap may be coupled to horizontal support 160 or chest pad 168 and looped under a user's arms. Thus, when a user performs an exercise that forces them away from the machine (e.g., a press), the strap may assist in resisting any motion. Additionally, a strap may assist in stabilizing a user's torso during various exercises.

The strap may be made of cloth, nylon, or any other appropriate material. The strap may be continuous or segmented (e.g., coupled together with a hook and loop fasteners or bayonet fasteners). In certain implementations, the length of the strap around the user may be adjustable. In certain implementations, the strap may be coupled to one or more of the frames.

Although system 100 has primarily has been discussed in terms of fluid cylinders (e.g., hydraulic and pneumatic) providing resistance, other implementations may also incorporate other types of resistance devices. For example, counterweights could be achieved with vertically-displaced weights, elastic elements (e.g., flexible bands), and/or any other appropriate type of resistance device. For instance, elastic elements could be provided as a counter weight for assembly 140. In system 100, for example, one or more elastic bands could be coupled to cross member 144 and to frame 120 (e.g., to vertical or horizontal members). A weight could also be added to assembly 140 on the same side of the pivot as cross member 144. Resistance devices could also be located at various other locations on system 100 to provide counterweights. Additionally, in certain implementations, the cylinders may be replaced with other types of resistance devices (e.g., vertically-displaced weights, elastic elements, etc.).

Although system 100 is primarily design for wheelchair-bound users (e.g., those with spinal cord injuries), patients in rehabilitation settings for an array of illnesses (e.g., chronic co-morbidities) and elderly patients seeking a safe exercise solution in their home may also use system 100 (or slight modification thereof). There is widespread recognition that any exercise at all can have meaningful impacts on chronic conditions ranging from cardiovascular disease to depression.

Grip assistance may be a feature for many upper body exercise systems for paraplegic and quadriplegic individuals. This may be a key feature for individuals with injuries in the cervical spine. The spinal nerve that controls grip strength is lower than the one that innervates the large muscle groups in the shoulder, back, and arms. As a result, users often have the arm strength to perform many exercises, but they are unable to grip the machine or weight.

Figure 4:
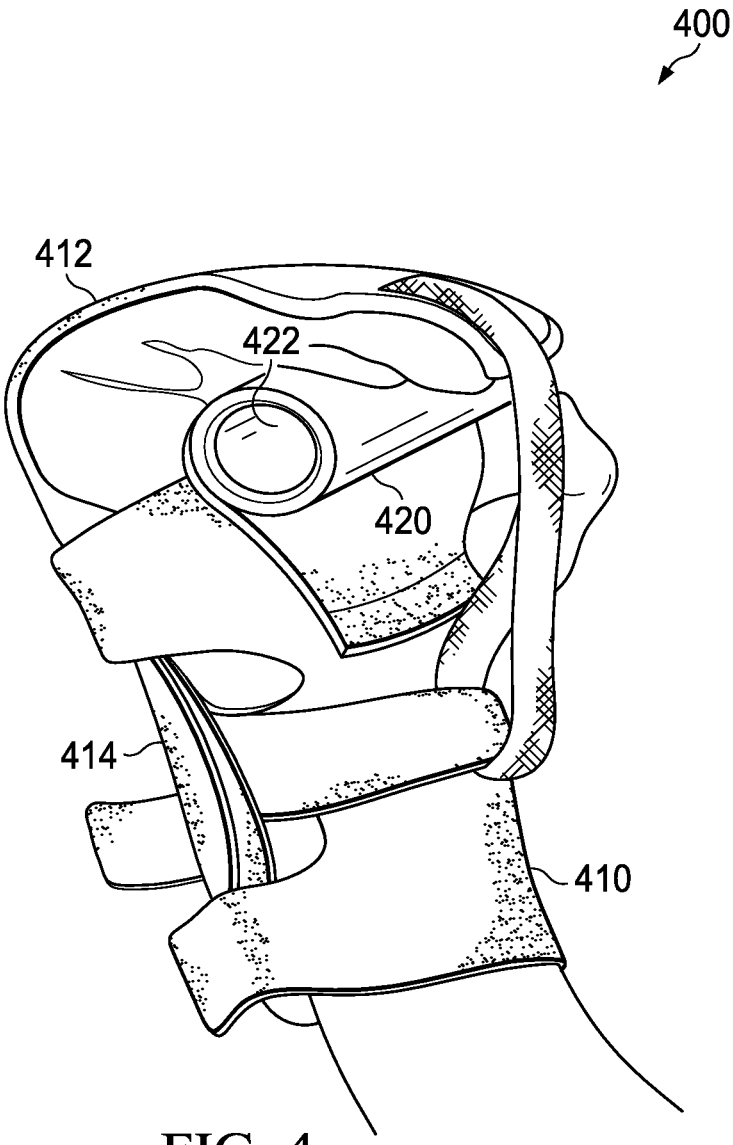
FIG. 4 illustrates an example grip assistance system for use with an exercise system.

FIG. 4 illustrates an example grip assistance system 400 for use with an exercise system like exercise system 100. Grip assistance system 400 includes a glove 410 with a built-in curved portion 412 in the finger section (forming a cup). Mounted inside the cup portion 412 is a tube 420 (e.g., a handgrip) that corresponds to handles mounted on an exercise system. The tube 420 has a bore 422 therethrough that is large enough to slide over handles of an exercise system. Glove 410 is secured to the user's hand by a wrist strap 414.

In operation, an exercise system may have regular handgrips on those portions that correspond to limbs for which the user has acceptable grip strength. For those portions for which the user does not have acceptable grip strength, the handgrips may be removed from the exercise system, exposing the handle, which is typically made of metal. For example, a system may have handgrips on one side and handles on the other side. With glove 410 on, the user may slip the tube onto the handle where the handgrip has been removed and perform an exercise. Also, the user may remove grip assistance system 400 from one handle (e.g., by slipping the tube 420 off the handle) and engage another handle of the exercise system (to perform another exercise). Thus, the user may change hand positions quickly while using grip assistance system 400.

In particular implementations, glove 410 may be an Action Life Glove, which is available from Southern Glove, Inc. of Newton, N.C. (USA) and Access to Recreation, Inc. (www.accesstr.com). Tube 420 may, for example, be a commercially available handgrip.

Grip assistance system 400 has a variety of features. For example, it allows a user to perform exercises that could not be performed and to quickly change between exercises.

Although several implementations have been described, by written and graphic techniques, the exercise system is not confined to the configurations shown. In particular, the exercise system may be sized differently depending on different users (e.g., heights, widths, ranges of motion, etc.). Moreover, different materials may allow for different configurations of the elements (e.g., the base, the vertical frame, etc.).

Several implementations have been disclosed and many others have been mentioned or suggested. Additionally, those skilled in the art will readily recognize that a variety of additions, deletions, substitutions, and modifications may be made while still achieving a wheelchair-accessible exercise system. Thus, the scope of the protected subject matter should be judged based on the following claims, which may encompass one or more features of one or more implementations.

The invention claimed is:

1. A wheelchair-accessible exercise system comprising:

a base sized to receive a wheelchair at a position;

a first frame pivotably coupled to the base, the first frame being a rigid, integrated unit that is movable through an angular range that defines an upper portion of a vertical arc;

at least one hydraulic piston coupled between the base and the first frame, the hydraulic piston constraining the motion of the first frame such that it moves substantially more in the horizontal direction than it does in the vertical direction during an exercise stroke;

a vertical frame coupled to the base;

a second frame pivotably coupled to the vertical frame, the second frame being a rigid, integrated unit that is movable through an angular range that defines a side portion of a vertical arc, wherein the different movement directions of the first frame and the second frame provide different exercises for a user at the position;

at least one hydraulic piston coupled between the vertical frame and the second frame, the hydraulic piston constraining the motion of the second frame such that it moves substantially more in the vertical direction than it does in the horizontal direction during an exercise stroke; and a hand cycle coupled to the vertical frame;

wherein a user in a wheelchair may access the first frame, the second frame, and the hand cycle when located at the position.

2. The exercise system of claim 1, wherein the resistances offered by the hydraulic pistons are adjustable.

3. The exercise system of claim 1, wherein the attachment points of the hydraulic pistons are adjustable.

4. The exercise system of claim 1, wherein the base comprises a base plate adapted to receive a wheelchair thereon.

5. The exercise system of claim 1, wherein the height of the hand cycle is adjustable.

6. The exercise system of claim 1, wherein the horizontal location of the hand cycle is adjustable.

7. The exercise system of claim 1, further comprising a chest engagement assembly.

8. The exercise system of claim 7, wherein the chest engagement assembly is horizontally adjustable.

9. The exercise system of claim 1, further comprising a grip-assistance system adapted to receive a user's hand and including a tubular member, the tubular member sized to be removably received on one or more handles of the exercise system.

10. The exercise system of claim 9, wherein the grip-assistance system is adapted to be secured to a user's hand.

11. The exercise system of claim 9, wherein the tubular member comprises a handgrip.

12. The exercise system of claim 9, wherein the first frame, the second frame, and the hand cycle each include handgrips on one lateral side and handles on the other lateral side.

13. The exercise system of claim 1, wherein:

the first frame includes two horizontally spaced locations for a user to grasp the frame with respective hands when located at the position; and the second frame includes two horizontally spaced locations for a user to grasp the frame with respective hands when located at the position.

14. The exercise system of claim 13, wherein:

the two horizontally spaced locations of the first frame comprise two horizontally spaced handles; and the two horizontally spaced hand locations of the second frame comprise two horizontally spaced handles.

15. The exercise system of claim 14, wherein the first frame includes a second set of two horizontally spaced handles.

16. The exercise system of claim 15, wherein the two sets of handles of the first frame move in unison with each other.

17. The exercise system of claim 14, wherein the two handles of the first frame move in unison with each other.

18. The exercise system of claim 1, wherein the first frame is pivotably connected directly to the base.

19. A wheelchair-accessible exercise system comprising:

a base sized to receive a wheelchair at a position;

a first frame pivotably coupled to the base, the first frame being a rigid, integrated unit that is movable through an angular range that defines an upper portion of a vertical arc such that the frame moves substantially more in the horizontal direction than it does in the vertical direction during an exercise stroke;

a vertical frame coupled to the base;

a second frame pivotably coupled to the vertical frame, the second frame being a rigid, integrated unit that is movable through an angular range that defines a side portion of a vertical arc such that the frame moves substantially more in the vertical direction than it does in the horizontal direction during an exercise stroke, wherein the different movement directions of the first frame and the second frame provide different exercises for a user at the position; and a hand cycle coupled to the vertical frame;

wherein a user in the wheelchair may access the first frame, the second frame, and the hand cycle when located at the position.

20. The exercise system of claim 19, further comprising:

at least one hydraulic piston coupled between the base and the first frame such that movement of the first frame away from the vertical frame causes the piston to elongate; and at least one hydraulic piston coupled between the vertical frame and the second frame such that movement of the second frame downward causes the piston to elongate.

21. The exercise system of claim 20, wherein the resistances offered by the hydraulic pistons are adjustable.

22. The exercise system of claim 20, wherein the attachment points of the hydraulic pistons are adjustable.

23. The exercise system of claim 19, wherein the base comprises a base plate adapted to receive a wheelchair thereon.

24. The exercise system of claim 19, wherein the height of the hand cycle is adjustable.

25. The exercise system of claim 19, further comprising a chest engagement assembly.

26. The exercise system of claim 19, further comprising a grip-assistance system adapted to receive a user's hand and including a tubular member, the tubular member sized to be removably received on one or more handles of the exercise system.

27. The exercise system of claim 19, wherein:

the first frame includes two horizontally spaced locations for a user to grasp the frame with respective hands when located at the position; and the second frame includes two horizontally spaced locations for a user to grasp the frame with respective hands when located at the position.

28. The exercise system of claim 27, wherein:

the two horizontally spaced locations of the first frame comprise two horizontally spaced handles; and the two horizontally spaced hand locations of the second frame comprise two horizontally spaced handles.

29. The exercise system of claim 28, wherein the first frame includes a second set of two horizontally spaced handles.

30. The exercise system of claim 19, wherein the first frame is pivotably connected directly to the base.

* * * * *